US006217144B1

(12) United States Patent
Myung

(10) Patent No.: US 6,217,144 B1
(45) Date of Patent: Apr. 17, 2001

(54) METHOD FOR CHECKING NOZZLE CONTACT STATUS OF RECORDING HEAD IN INK JET RECORDING APPARATUS

(75) Inventor: Ho-Suck Myung, Ahnsan (KR)

(73) Assignee: Samsung Electronics Co., Ltd., Suwon (KR)

( * ) Notice: Subject to any disclaimer, the term of this patent is extended or adjusted under 35 U.S.C. 154(b) by 0 days.

(21) Appl. No.: 08/882,599

(22) Filed: Jun. 25, 1997

(30) Foreign Application Priority Data

Jun. 25, 1996 (KR) ..... 96-23614

(51) Int. Cl.[7] ..... B41J 29/377
(52) U.S. Cl. ..... 347/19; 347/19; 347/23
(58) Field of Search ..... 347/9, 19, 23, 347/57, 22

(56) References Cited

U.S. PATENT DOCUMENTS

| | | | | |
|---|---|---|---|---|
| 4,293,867 | * | 10/1981 | Isayama | 347/23 |
| 4,357,614 | | 11/1982 | Tamai . | |
| 4,542,389 | | 9/1985 | Allen . | |
| 4,996,487 | * | 2/1991 | McSparran et al. | 324/59 |
| 5,389,961 | | 2/1995 | Takagi | 347/29 |
| 5,455,608 | * | 10/1995 | Stewart et al. | 347/23 |
| 5,485,286 | * | 1/1996 | Ejiri et al. | 358/296 |
| 5,574,488 | | 11/1996 | Tamura | 347/63 |
| 5,581,286 | | 12/1996 | Hayes et al. | 347/71 |
| 5,604,521 | | 2/1997 | Merkel et al. | 397/47 |
| 5,903,285 | * | 5/1999 | Ju et al. | 347/5 |

OTHER PUBLICATIONS

Graf, Encyclopedia of Electronic Circuits, vol. 2, Figure 9–7, 1998.*

Graf, Encyclopedia of Electronic Circuits vol. 2, ©1998, Figure 9–7, Dec. 1998.*

* cited by examiner

*Primary Examiner*—John Barlow
*Assistant Examiner*—Alfred Dudding
(74) *Attorney, Agent, or Firm*—Robert E. Bushnell, Esq.

(57) ABSTRACT

An ink jet recording apparatus of the invention checks a nozzle contact status of the recording head, when a nozzle slip-out occurs. If the nozzle slip-out has occurred because the nozzle is choked up, then the nozzle is automatically cleaned up. Otherwise, such as if the nozzle slip-out is caused by the poor contact of the nozzle, then the ink cartridge moves to a replacing position to inform the user that the nozzle has the poor contact. Thus, the user can easily learn of the nozzle contact status and quickly take proper measures.

10 Claims, 3 Drawing Sheets

METHOD FOR CHECKING NOZZLE CONTACT STATUS OF RECORDING HEAD IN INK JET RECORDING APPARATUS

CLAIM OF PRIORITY

This application makes reference to, incorporates the same herein, and claims all benefits accruing under 35 U.S.C. §119 from an application entitled Method For Checking Nozzle Contact Status of Recording Head in Ink Jet Recording Apparatus earlier filed in the Korean Industrial Property Office on Jun. 25, 1996, and there duly assigned Ser. No. 96-23614 by that Office.

BACKGROUND OF THE INVENTION

1. Field of the Invention

The present invention relates to an ink jet recording apparatus. More particularly, the present invention relates to a method for checking a contact status of nozzles mounted on an ink jet recording head.

2. Description of the Related Art

An image recording apparatus can be a wire dot printer, a thermal printer, an ink jet printer etc. An image recording apparatus may include a unique recording head for recording image data on a recording medium such as a recording paper and an OHP (overhead project) film. Among the such mentioned various image recording apparatuses, the ink jet recording apparatus is an image recording apparatus that ejects ink on the recording medium for recording the image data. A recording head, employed in such an ink jet recording apparatus, may include a plurality of nozzles each having a fine ejection hole. Upon being heated by heating elements mounted on the respective nozzles, the ink filled in the nozzle is expanded and ejected from the nozzle. The ejected ink is transferred to the recording medium. Such an ink jet recording apparatus records the image data by selectively driving the nozzles mounted on the recording head according to the image data to be recorded. The nozzles are driven by a head driver circuit. When the ink jet recording apparatus records graphic or text data, a white horizontal line may occur on the recorded image. This is undesirable, as it degrades the quality of the recorded image. In some parlance, the occurrence of the white horizontal line is called a "nozzle slip-out phenomenon." The nozzle slip-out occurs not only when the nozzle is choked up, but also when the nozzle has a poor contact. Thus, the detection the nozzle slip-out and the detection of the cause of the nozzle slip-out are important. Among exemplars of this art of such types of control, sensing, and arrangement of the nozzles and printeads, Merkel et al. (U.S. Pat. No. 5,604,521, Self-Aligning Orifice Plate For Ink Jet Printheads, Feb. 18, 1997) discusses an orifice plate having a projection that is configured to be closely received by a corresponding alignment cavity in the front end body portion of the printhead. Hayes et al. (U.S. Pat. No. 5,581,286, Multi-channel Array Actuation System For An Ink Jet Printhead, Dec. 3, 1996) discusses ejecting volume modulatable droplets of ink from the ink jet printhead by sequentially applying a voltage pulse having a selected time duration to the first ink carrying channel and a voltage pulse having a time duration ranging between zero and the selected time duration to the second ink carrying channel. Tamura (U.S. Pat. No. 5,574,488, Liquid Jet Head, Liquid Jet Head Cartridge, And Liquid Jet Apparatus, Nov. 12, 1996) discusses a liquid jet head for recording, having elements for generating discharge energy to discharge a liquid. The head has a plurality of liquid passages and is pressed to be in close contact with the surface of the elemental base board on the side where the elements for generating discharge energy are arranged. Takagi (U.S. Pat. No. 5,389,961, Ink Jet Printer With Variable-Force Ink Declogging Apparatus, Feb. 14, 1995) discusses an ink jet printer having an apparatus for preventing ink clogs from interfering with the flow of ink from a printing nozzle during a printing operation. A printing nozzle is operably coupled to the chamber when the printing nozzle is not being used in a print operation. Allen (U.S. Pat. No. 4,542,389, Self-Cleaning Ink Jet Drop Generator Having Crosstalk Reduction Features, Sep. 17, 1985) discusses a nozzle plate having isolator holes which are connected to a refill plenum to help dissipate disturbance energy in the ink to reduce fluidic crosstalk between emitters in multi-emitter heads. Tamai (U.S. Pat. No. 4,357,614, Ink Particle Jetting Device For Multi-Nozzle Ink Jet Printer, Nov. 2, 1982) discusses a ink jetting device in which a plurality of silicon chips having nozzle arrays formed therein are mounted on a substrate having a plurality of holes therein with the nozzle arrays confronting the holes of the substrate. From my study of the contemporary practice and art, I find that there is a need for an improved and effective control, sensing, and arrangement of the nozzles and printheads, especially the particular control sequences of the present invention.

SUMMARY OF THE INVENTION

Thus, an object of the present invention is to provide an improved ink jet recording apparatus.

Another object of the present invention is to provide an improved method for checking a contact status of nozzles mounted on an ink jet recording head.

Another object of the present invention is to provide an improved method for automatically checking an electrical contact status of a nozzle.

Another object of the present invention is to provide a method for checking an electrical contact status of a nozzle when a nozzle slip-out occurs, and automatically cleaning the nozzle, if the nozzle has a good contact.

To achieve these and other objects, an ink jet recording apparatus according to the present invention sequentially drives nozzles one by one. This happens if a nozzle slip-out occurs during printing, so as to check whether each of the nozzles operates normally or not. If all of the nozzle operate normally, then the nozzles are automatically cleaned up. If at least one of the nozzles operates abnormally, however, then an ink cartridge on which the recording head is mounted is moved to a predetermined replacing position to notify a poor contact status of the nozzles.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE PREFERRED EMBODIMENTS

Figure 1:
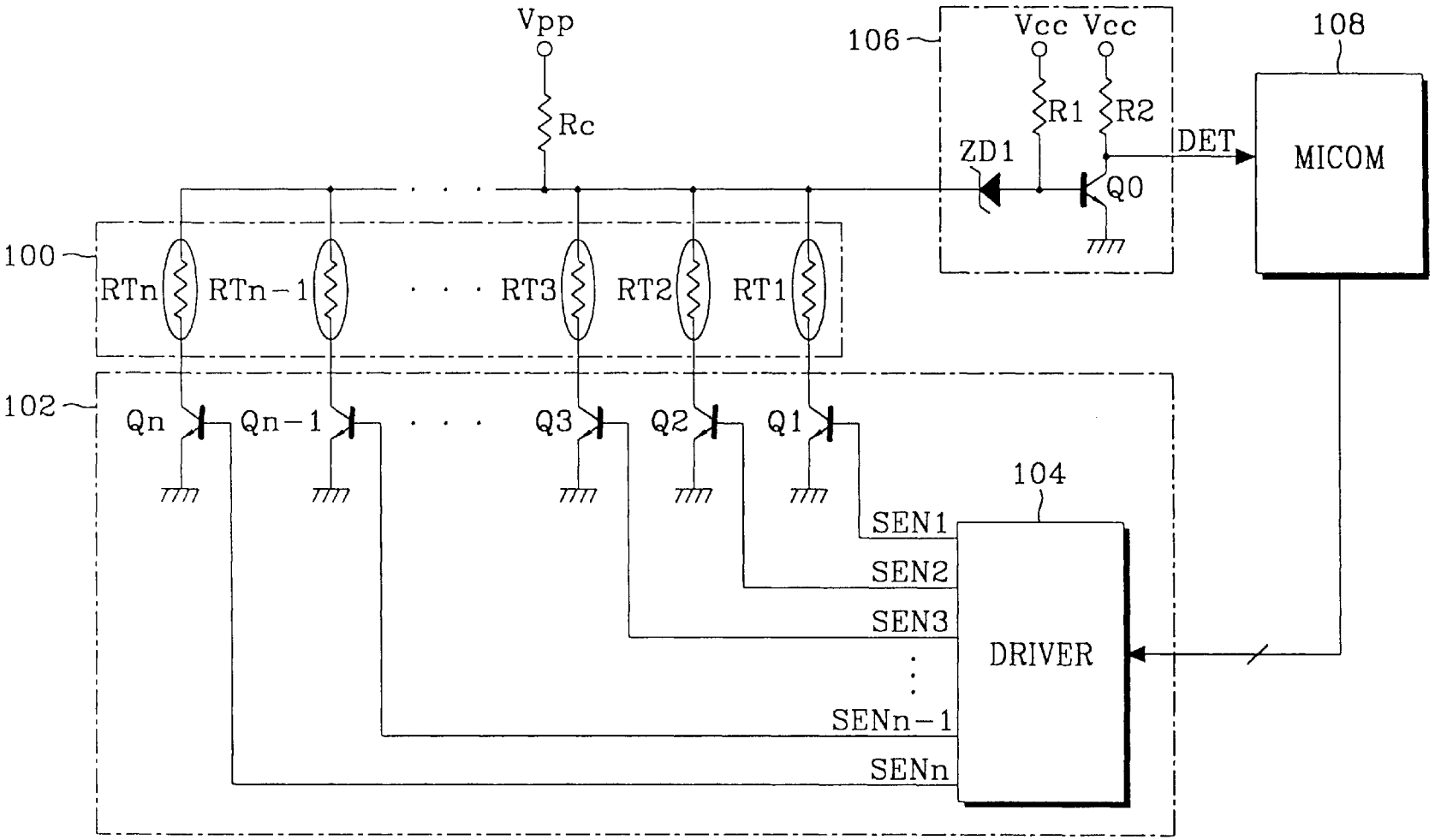
FIG. 1 is a circuit diagram showing a partial circuit of an ink jet recording apparatus built in accordance with the principles of the present invention.

When the ink jet recording apparatus records graphic or text data, a white horizontal line may occur on the recorded image. This is undesirable, as it degrades the quality of the recorded image. In some parlance, the occurrence of the white horizontal line is called a "nozzle slip-out phenomenon." In this case, the user should execute a self-diagnostic printing function so as to check whether or not any one of the nozzles are defective. In the self-diagnostic printing, the recording head drives all the nozzles sequentially, one by one, to print a test pattern. From the printed test pattern, the user can find the particular nozzle that is defective, if any. Such a self-diagnostic printing function is commonly employed in the ink jet recording apparatus. The nozzle slip-out is commonly caused by two main reasons, excepting the instances that the heating element or head driver circuit is defective. First, as the ink within the nozzle is vaporized, the viscosity of the ink is increased. Then, an air bubble or a dust particle may penetrate into the nozzles so that the nozzle is choked up. Then, the nozzle choked up fails to eject the ink. Second, when the heating element of the nozzle has a bad electrical contact with the head driver circuit, the nozzle slip-out occurs.

Because the recording head is assembled into an ink cartridge in a body, the recording head is used and disused together with the cartridge in case that the cartridge runs out of the ink. The ink cartridge is detachable from a carriage and replaceable with new one. Further, the nozzles of the recording head are driven by the head driver circuit prepared in a main body of the ilk jet recording apparatus. A connection between the nozzles and the head driver circuit is realized by making contacts between conductive contact points formed on flexible printed circuits (FPC) attached on the respective surfaces of the ink cartridge and the carriage. Therefore, if the ink cartridge is not accurately mounted on the carriage, some of the contact points will make poor contacts. Then, the nozzle of which contact point has a poor contact fails to eject the ink, thereby causing the nozzle slip-out phenomenon. As described in the previous sentences, the nozzle slip-out occurs not only when the nozzle is choked up, but also when the nozzle has a poor contact. Therefore, when the user perceives the white horizontal line on the printed test pattern through the self-diagnostic printing function, it is uncertain to the user what has exactly caused the nozzle slip-out phenomenon to occur. Accordingly, upon perceiving the nozzle slip-out, the user should first execute a nozzle cleaning function to clean up the choked nozzle. The nozzle cleaning function which is commonly employed in the ink jet recording apparatus is to eject out or suck in the ink within the nozzle, so as to clean up the choked nozzle. After cleaning the nozzle, if the nozzle slip-out still occurs, the user should separate the ink cartridge from the carriage. Thereafter, the user should clean the contact points, and reinstall the ink cartridge on the carriage.

As mentioned in the previous paragraphs, in a contemporary practice, when the nozzle slip-out occurs, it is uncertain to the user what has exactly caused the nozzle slip-out to occur, so that the user should take all the measures stated above. The present invention poses a solution to this situation.

FIG. 1 shows a partial circuit diagram of an ink jet recording apparatus to which the present invention is applicable. In the drawing of FIG. 1, a recording head 100 includes a plurality of heating elements RT1–RTn being mounted respectively on corresponding nozzles (not shown). The nozzles are mounted on the recording head 100. Being driven by a head driver circuit 102, the heating elements RT1–RTn expands the ink within the nozzles to eject ink. One end of each of the heating elements RT1–RTn are commonly connected to a driving voltage Vpp via a common resistor Rc.

The head driver circuit 102 includes a plurality of transistors Q1–Qn and a driver 104. The driver 104 connected between the transistors Q1–Qn and a microcomputer 108 selectively generates driving enable signals SEN1–SENn according to driving data from the microcomputer 108. The driving enable signals SEN1–SENn are supplied to the associated transistors Q1–Qn. The transistors Q1–Qn are connected between another ends of the heating elements RT1–RTn and the ground. The transistors Q1–Qn are turned on in response to the driving enable signals SEN1–SENn, to cause the heating elements RT1–RTn to generate heat. A head driving detection circuit 106 is composed of a zener diode ZD1 and resistors R1 and R2, and a transistor Q0. The zener diode ZD1 has an anode connected to a supply voltage Vcc via a resistor R1 and a cathode connected to a conjunction node of the common resistor Rc and the heating elements RT1–RTn. Further, the transistor Q0 has a base connected to the anode of the zener diode ZD1, a collector connected to the supply voltage Vcc via a resistor R2, and an emitter connected to the ground. Often, the driving voltage Vpp is 24V and the supply voltage Vcc is 5V. With these components, the head driving detection circuit 106 generates a detection signal DET to the microcomputer 108, when at least one of the heating elements RT1–RTn are driven to be heated.

As to the interactions among these components, if at least one of the transistors Q1–Qn is turned on and the corresponding heating elements are driven, then the transistor Q0 is turned off. Thus, this generates the detection signal DET of the logic high level at the collector thereof. In contrast, if the transistors Q11–Qn are all turned off, the transistor Q0 is turned on, thereby generating the detection signal DET of the logic low level. Further, although one or more transistors are turned on, if the corresponding heating elements are not driven because of a poor contact of the nozzle (i.e., a poor contact of the heating element), the transistor Q0 is also turned on, thereby generating the detection signal DET of the logic low level. Upon receiving the detection signal DET of the logic low level, the microcomputer 108 perceives that the recording head operates abnormally.

Figure 2:
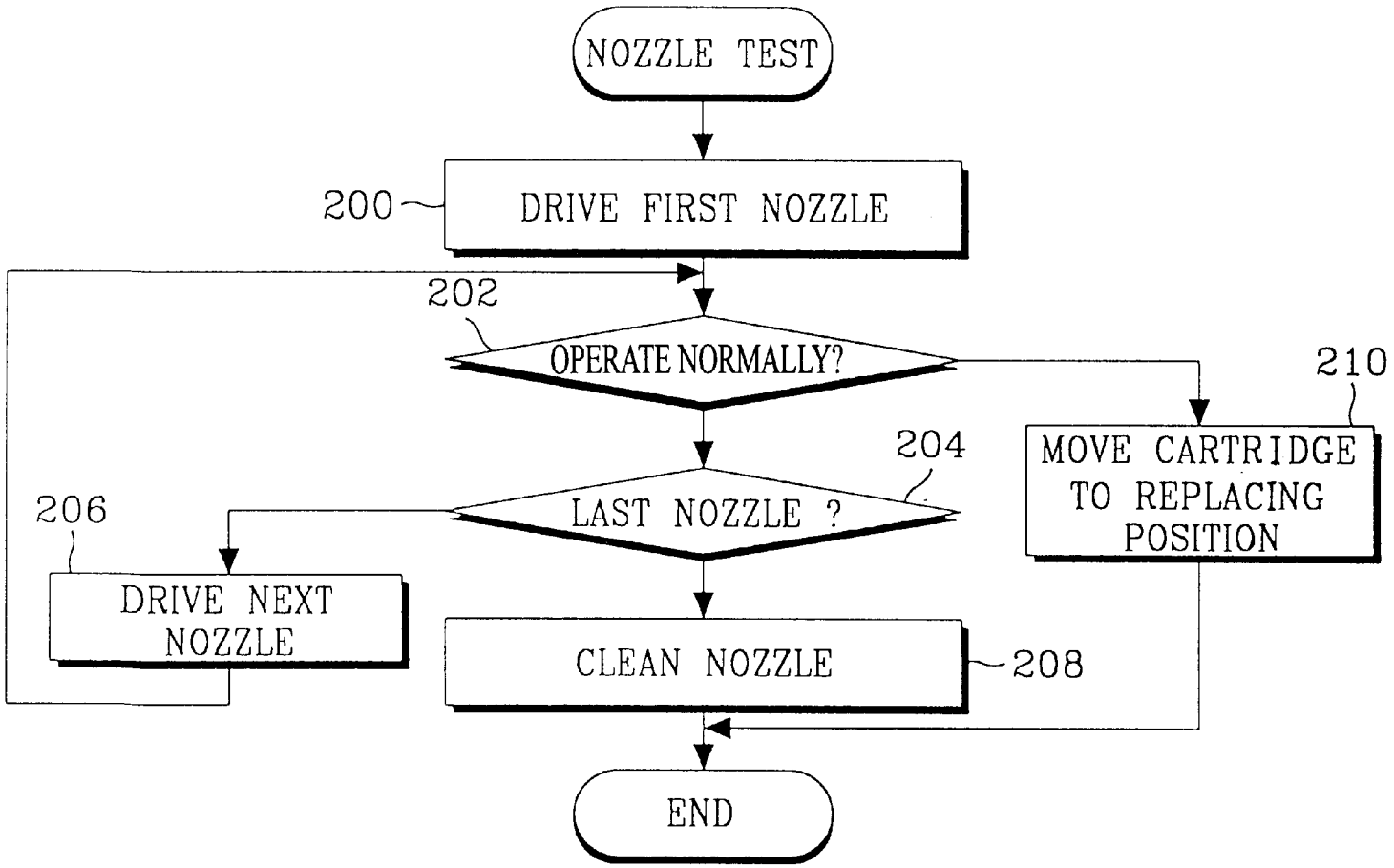
FIG. 2 is a flow chart for checking a nozzle contact status according to an embodiment of the present invention.

FIG. 2 shows a flow chart for checking the nozzle contact status, in which the microcomputer 108 includes the step of: sequentially driving the nozzles one by one, if a nozzle slip-out occurs during printing. Then, nozzles are checked as to whether each of the nozzles operates normally or not. Among other steps may be: cleaning the nozzles, if all of the nozzles operate normally; and if at least one of the nozzles operates abnormally, moving an ink cartridge on which the recording head is mounted to a predetermined replacing position to notify a poor contact status of the nozzles.

Figure 3:
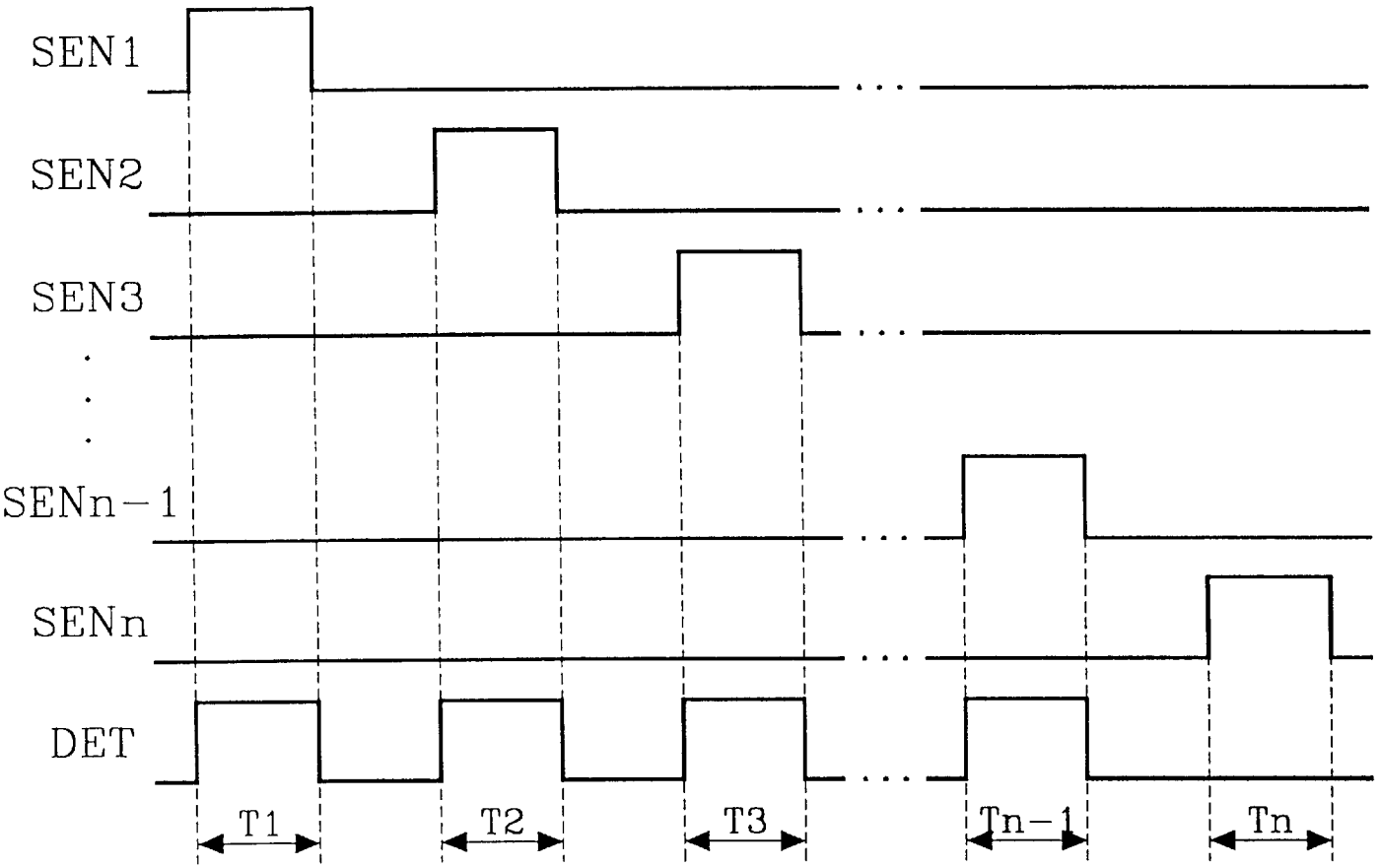
FIG. 3 is an operational timing diagram of parts of the circuit shown in FIG. 1.

As for FIG. 3, there is shown an operational timing diagram of each part of the circuit shown in FIG. 3, in which the n-th heating element RTn is not driven because of a poor contact of the nozzle. As shown in FIGS. 1 through 3, a preferred embodiment of the present invention can be as follows. If the nozzle slip-out occurs during printing, the user will execute the self-diagnostic printing function. Then, the microcomputer 108 begins to execute the nozzle test process according to the flow chart shown in FIG. 2.

In particular, at steps 200 through 206, the microcomputer 108 sequentially drives the nozzles (i.e. from the first heating element RT1 to the n-th heating element RTn), one by one, and checks whether or not each nozzle operates normally based on the detection signal DET generated from the head driving detection circuit 106. First, the driver 104 generates the first driving enable signal SEN1 under the control of the microcomputer 108. The first driving enable signal SEN1 maintains the logic high level at an interval T1 as shown in FIG. 3. Then, the transistor Q1 is turned on. At this time, if the first nozzle has a good electrical contact (i.e., if the heating element RT1 is accurately connected to the transistor Q1), the transistor Q0 is turned off. Thus, the detection signal DET generated from the head driving detection circuit 106 maintains the logic high state at the interval T1 as shown in FIG. 3. Then, the microcomputer 108 judges that the first nozzle has a good contact and operates normally. Thereafter, the driver 104 generates the second driving enable signal SEN2 under the control of the microcomputer 108 to drive the second nozzle, i.e., the second heating element RT2. Then, the above stated operation is repeated for the second nozzle. After repeating the above stated operations from the first nozzle to the last nozzle, if it is judged that all the nozzles operate normally, then the microcomputer 108 executes the normal nozzle cleaning function at a step 208. Also, the microcomputer 108 would stop the nozzle test operation at this situation.

In this particular situation, as the nozzle slip-out has occurred because the nozzle is choked up, the normal cleaning function is automatically executed. Because the nozzle cleaning function is well known in the art, detailed description will be omitted. In contrast, if the n-th nozzle (i.e., the n-th heating element RTn), for example, is not driven, the detection signal DET maintains the logic low level at an interval Tn as shown in FIG. 3. Then, at a step 210, the microcomputer 108 moves the ink cartridge to a replacing position, notifying that the nozzle slip-out is caused by the poor contact of the nozzle. Then, the user may separate ink cartridge from the carriage to clean the contact points of the ink cartridge and the carriage, and re-mounts the ink cartridge on the carriage, so as to cancel the nozzle slip-out phenomenon. The above mention operation for moving the ink cartridge to the replacing position is well known in the art, so detailed description will be omitted. In a common ink jet recording apparatus, if the user pushes a particular key for replacing the ink cartridge, the ink cartridge is move to a predetermined replacing position and the operation status is visibly indicated through a light emitting diode. In accordance with the present invention, if the nozzle slip-out occurs, the nozzle contact status is automatically checked and informed. Thus, it is not necessary for the user to separately check the correct reasons for the nozzle slip-out. If the nozzle slip-out is not caused by the poor contact of the nozzle, the nozzle is automatically cleaned up, thereby canceling the nozzle slip-out. Thus, in this case, the user shouldn't take any separate measures. Also, if the nozzle slip-out is caused by the poor contact of the nozzle, the ink cartridge moves to a replacing position. This informs that the nozzle has the poor contact.

As described in the previous paragraphs, an ink jet recording apparatus of the invention checks a nozzle contact status of the recording head upon an occurrence of the nozzle slip-out. If the nozzle slip-out has occurred because the nozzle is choked up, then the nozzle is automatically cleaned up. Otherwise, if the nozzle slip-out is caused by the poor contact of the nozzle, the ink cartridge moves to a replacing position to inform that the nozzle has the poor contact. Due to this reason, the user can easily perceive the nozzle contact status and quickly take proper measures.

Although a preferred embodiment of the present invention has been described in detail hereinabove, it should be clearly understood that many variations and/or modifications of the basic inventive concepts herein taught which may appear to those skilled in the art will still fall within the spirit and scope of the present invention as defined in the appended claims.

What is claimed is:

1. In a detection module for checking a nozzle contact status of a recording head in an ink jet recording apparatus, said ink jet recording apparatus comprising:

a recording head having a plurality of heating elements and a corresponding plurality of nozzles, each of said heating elements mounted on one of said nozzles of said recording head;

a head driver circuit having a plurality of driver circuit transistors and a driver, each driver circuit transistor connected to a one of said heating elements; and a detection module comprising:

a head driving detection circuit adapted to be connected to said recording head, said head driving detection circuit adapted for receiving information from said recording head as to whether one of said nozzles are slipping; and a microcomputer coupled to said head driving detection circuit, said microcomputer adapted for determining whether said nozzles operate normally upon a one of said nozzles slipping during a printing process, said microcomputer adapted to indicate a bad contact;

the improvement comprising a detection module comprising;

a zener diode adapted to be connected to said recording head;

a first driving detection resistor connected to said zener diode;

a head driving detection transistor connected to said zener diode and to said microcomputer;

a second driving detection resistor connected to said head driving detection transistor; and said microcomputer adapted to signal for a movement of the ink cartridge to a predetermined position upon said one of said nozzles not operating normally.

2. The apparatus of claim 1, wherein one of ends of said first driving detection resistor and one of ends of said second driving detection resistor are at same voltage.

3. The apparatus of claim 1, wherein a first end of said head driving detection transistor is connected to said first driving detection resistor, a second end of said head driving detection transistor is connected to said second driving detection resistor, and a third end of said head driving detection transistor is connected to a ground.

4. The apparatus of claim 1, wherein a cathode end of said zener diode is connected to said recording head, and an anode end of said zener diode is connected to said head driving detection transistor.

5. A method for determining a contact status of a nozzle connected to a recording head in an ink jet recording apparatus, said recording head including a plurality of nozzles, comprising the steps of:

(1) during a printing process, when a nozzle is detected to have slipped out, determining whether said nozzle operates normally; and (2) when said nozzle does not operate normally, notifying the contact status of said nozzle as being bad by moving an ink cartridge on which said recording head is mounted to a predetermined replacing position, said predetermined replacing position permitting replacement, wherein the contact status indicates whether a contact is made between conductive contact points located on flexible printed circuits of cartridge surfaces of said ink cartridge and cartridge surfaces of a carriage.

6. The method of claim 5, wherein the contact status indicates whether a contact is made between conductive contact points located on facing surfaces of said ink cartridge and of a carriage.

7. The method of claim 5, further comprising the step of cleaning said nozzles, upon all said nozzles being determined to operate normally.

8. The method of claim 5, wherein said determining is carried out by a head driving detection means for determining whether said nozzles of the recording head operate properly, said head driving detection means comprising:

a zener diode connected to said recording head;

a first driving detection resistor connected to said zener diode;

a head driving detection transistor connected to said zener diode and to a microcomputer; and a second driving detection resistor connected to said head driving detection transistor.

9. The method of claim 8, further comprising the step of:

during a printing process, when a nozzle is detected to have slipped out, sequentially driving said nozzles one by one.

10. A module for checking a nozzle contact status of a recording head in an ink jet recording apparatus, said recording head including a plurality of nozzles, said module comprising:

means for determining whether said nozzle operates normally, said means for determining to be used during a printing process, when a nozzle is detected to have slipped out; and means for notifying a bad contact status of said nozzle by moving an ink cartridge on which said recording head is mounted to a predetermined replacing position, said means for notifying to be used when said nozzle does not operate normally, said predetermined replacing position permitting replacement.

* * * * *